US006922475B2

(12) United States Patent
Hsieh

(10) Patent No.: US 6,922,475 B2
(45) Date of Patent: Jul. 26, 2005

(54) SHOCKPROOF MICROPHONE SUPPORT DEVICE

(76) Inventor: Wu-Hong Hsieh, No. 162, Chung Shan 2nd Rd., Lu Chou City, Taipei Hsien (TW)

( * ) Notice: Subject to any disclaimer, the term of this patent is extended or adjusted under 35 U.S.C. 154(b) by 694 days.

(21) Appl. No.: 09/932,057

(22) Filed: Aug. 16, 2001

(65) Prior Publication Data

US 2003/0035561 A1 Feb. 20, 2003

(51) Int. Cl.[7] ..... H04R 11/04

(52) U.S. Cl. ..... 381/368; 381/361; 381/363

(58) Field of Search ..... 381/368, 361, 381/366, 363

(56) References Cited

U.S. PATENT DOCUMENTS 4,194,096 A * 3/1980 Ramsey ..... 381/366
4,546,950 A * 10/1985 Cech ..... 248/610

* cited by examiner

*Primary Examiner*—Xu Mei
(74) *Attorney, Agent, or Firm*—Kolisch Hartwell, P.C.

(57) ABSTRACT

A shockproof microphone support device has a retaining base for retaining on a support rod, a supporting base secured on the retaining base, and a holder assembled on the supporting base by a shockproof strip for receiving a microphone. When the support rod receives a vibration or shock, the vibration passes through the retaining base and the supporting base to the shockproof strip, and then is absorbed by the shockproof strip, whereby potential undesirable noises generating from the microphone are effectively avoided.

1 Claim, 5 Drawing Sheets

SHOCKPROOF MICROPHONE SUPPORT DEVICE

BACKGROUND OF THE INVENTION

1. Field of the Invention

The present invention is related to a microphone support device, and more particularly to a microphone support device that is able to absorb vibration so as to avoid the undesirable noise generated by shock to the microphone.

2. Description of Related Art

A public-address system is especially useful in a public place, wherein the microphone is generally and widely applied in a concert or when delivering a speech.

With reference to FIG. 5, a conventional microphone support device mainly comprises a retaining base (60) and a casing pipe (62) for receiving a microphone. The retaining base (60) is defined with a thread hole therein (not shown) to receive one end of a support rod (not shown), and a crest portion defined with an aperture (61) is formed on a top of the retaining base (60). Two ears (63) are perpendicularly formed on the outer periphery of the casing pipe (62) and apart from each other so as to define a gap, wherein each ear (63) is defined with a hole (64) therein. When assembling the casing pipe (62) and the retaining base (60) together, the two ears (63) are respectively straddled on two sides of the crest portion of the retaining base (60), and the two holes (63) are in alignment with the aperture (61). Thus a screw (65) is able to sequentially insert into the holes (64) and the aperture (61) and then be received in a screw receiver (66).

When the foregoing support device is assembled with a microphone, if the support rod incurs a vibration or shock, such a vibration will pass to the microphone through the retaining base (60) and the casing pipe (62), whereby the undesirable noises are generated by the microphone.

Therefore, the invention provides a shockproof microphone support device to mitigate and/or obviate the aforementioned problems.

SUMMARY OF THE INVENTION

The main objective of the invention is to provide a shockproof microphone support device that is able to absorb vibration so as to avoid the generation of the undesirable noises.

Other objects, advantages and novel features of the invention will become more apparent from the following detailed description when taken in conjunction with the accompanying drawings.

DETAILED DESCRIPTION OF THE PREFERRED EMBODIMENT

Figure 1:
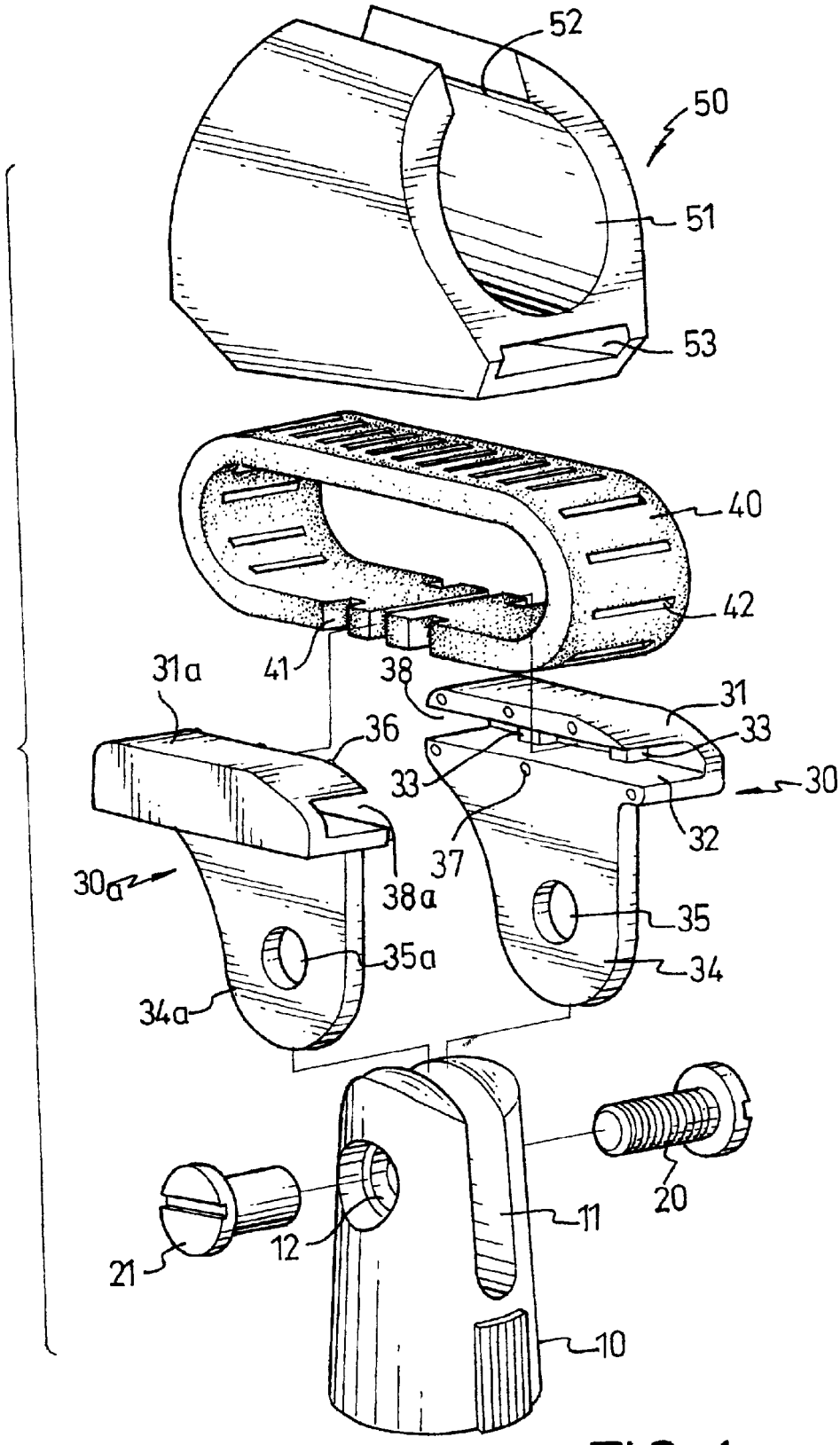
FIG. 1 is an exploded perspective view of a microphone support device in accordance with the present invention.

With regard to FIG. 1, a shockproof microphone support device in accordance with the present invention mainly comprises a retaining base (10), a first grip plate (30), a second grip plate (30*a*), a shockproof strip (40) and a holder (50).

The retaining base (10) is formed as a substantially tapered shape and has a threaded hole (not shown) defined in a bottom thereof. A slot (11) is downwardly and vertically defined in a top of the retaining base (10), and two holes (12) are respectively provided in two opposed side walls defining the slot (11), whereby each hole (12) communicates with the slot (11).

A supporting base made of the first grip plate (30) and the second grip plate (30*a*) is secured in the retaining base (10), wherein the structure of the first grip plate (30) and the second grip plate (30*a*) are substantially the same and symmetrical.

The first grip plate (30) has a U-like cross-section channel (38) defined by a top lateral portion (31), a bottom lateral portion (32), an upright portion (not numbered) extending between the top lateral portion (31) and the bottom lateral portion (32), and an ear plate (34) integrally and downwardly extending from a flange of the bottom lateral portion (32). The ear plate (34) further defines an aperture (35) in its central portion. A plurality of pin holes (37) are respectively and uniformly defined at the flanges of the top lateral portion (31) and bottom lateral portion (32). A plurality blocks (33) is formed on a sidewall of the upright part.

Most of the structure of the second grip plate (30*a*) is substantially the same as that of the first grip plate (30), wherein the only change is that the plurality of pin holes (37) is replaced with a plurality of pins (36) that corresponds to the plurality of pin holes (37).

Figure 2:
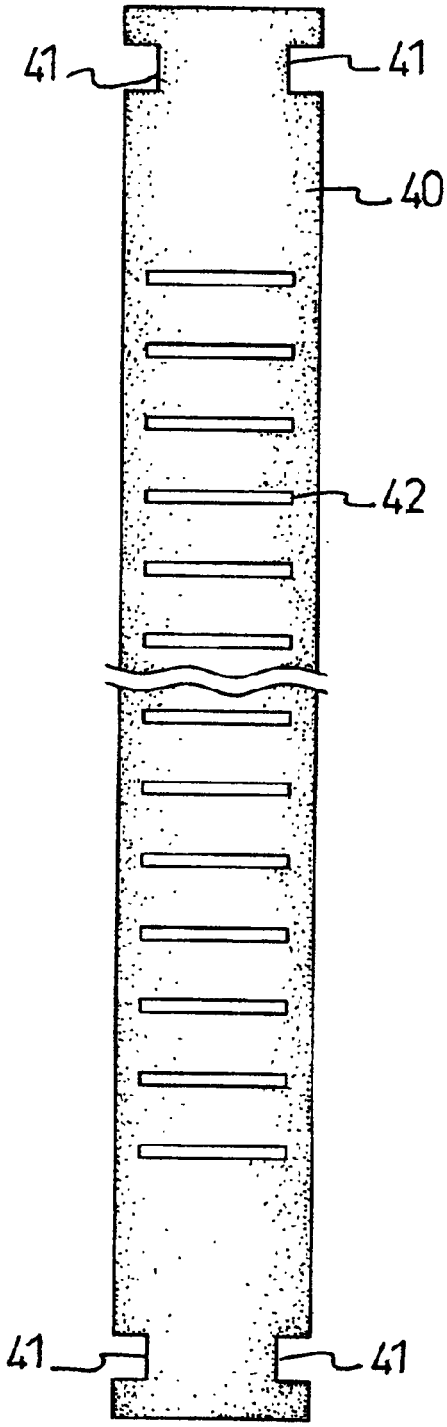
FIG. 2 is a plan view showing a shockproof strip in accordance with the invention.

With reference to FIG. 2, the shockproof strip (40) has two long edges. Two notches (41) are respectively defined in opposed ends of each long edge. A plurality of unpenetrated dents (42) are uniformly provided on the shockproof strip (40), and the material of the shockproof strip (40) is chosen as an elastic material, such as rubber.

With regard to FIG. 1, the holder (50) has a bottom (not numbered), and two arcuate portions uprightly and integrally extending from opposed sides of the bottom and toward each other, so that a hollow (51) is defined by the two arcuate portions for receiving a microphone. A through channel (53) is further lengthwise defined in the bottom of the holder (50).

Figure 3:
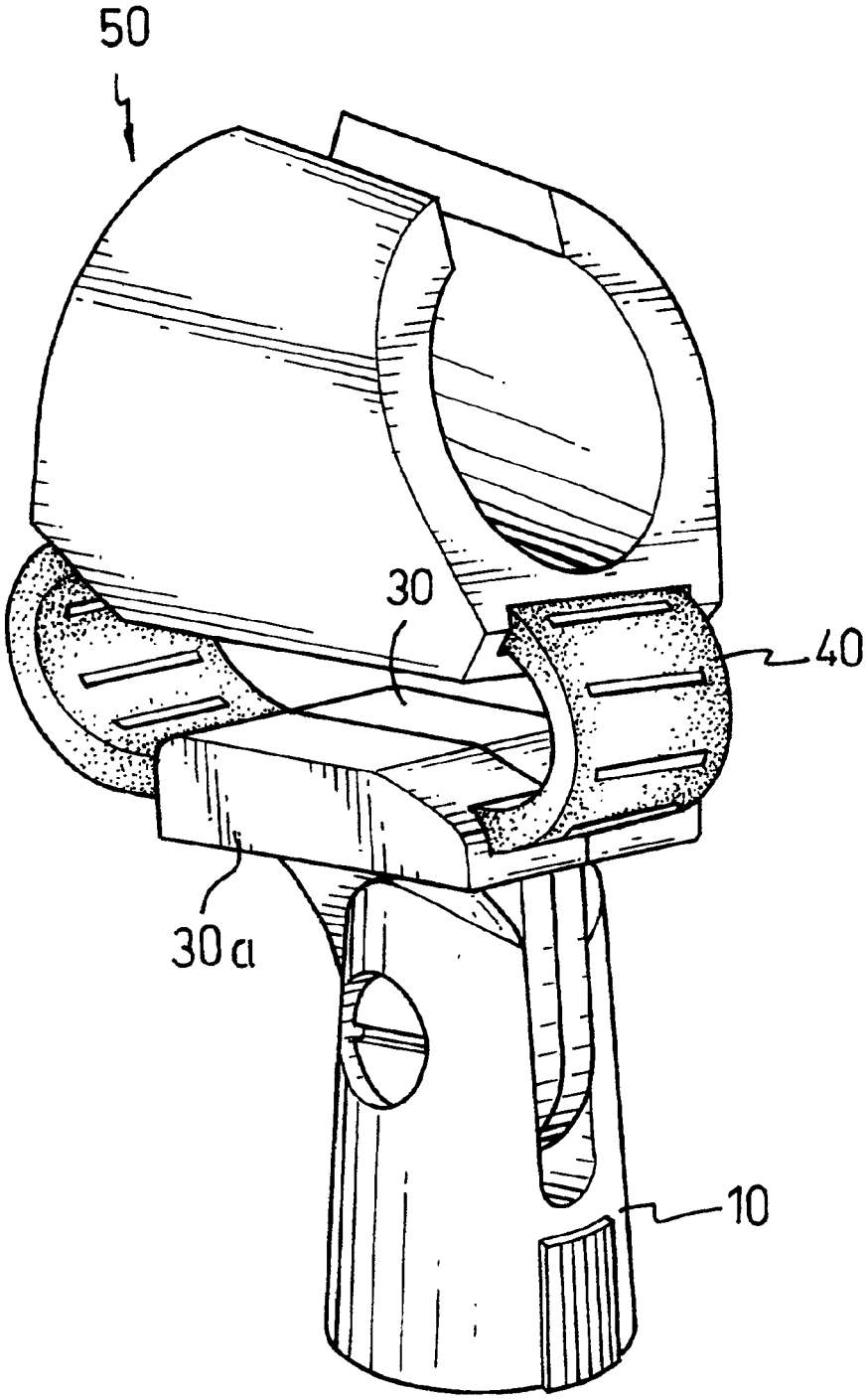
FIG. 3 is an assembled perspective view of the microphone support device shown in FIG. 1.

With reference to FIGS. 1 and 3, the operation to assemble the foregoing elements of the present invention is as following. First of all, the shockproof strip (40) is inserted into the channel (52) of the holder (50) and bent downward to form an elliptical ring. Because the plurality of the dents (42) is provided on the shockproof strip (40), the shockproof strip (40) is easily deformed and bent. Then, the first grip plate (30) and the second grip plate (30*a*) are provided on opposite sides of the shockproof strip (40) so that the first and second grip plates (30,30*a*) are able to engage with the shockproof strip (40). The two sides of the shockproof strip (40) are respectively received in the U-like cross-section channels (38, 38*a*) of the first grip plate (30) and the second grip plate (30*a*), and the blocks (33) of the first grip plate (30) and the second grip plate (30*a*) are received in the notches (41) of the shockproof strip (40). The plurality of pins (36) of the second grip plate (30*a*) are correspondingly received in the plurality of the pin holes (37). Furthermore, the ear plates (34, 34*a*) are in alignment with each other and collectively received in the notch (11), wherein the apertures (35, 35*a*) are also in alignment with the two holes (12) of the retaining base (10), whereby a screw (20) is able to insert into the two holes (12) and the apertures (35, 35*a*) and is received in a screw receiver (21), thus the first and second grip plates (30, 30*a*) are securely retained in the retaining base (10).

Figure 4:
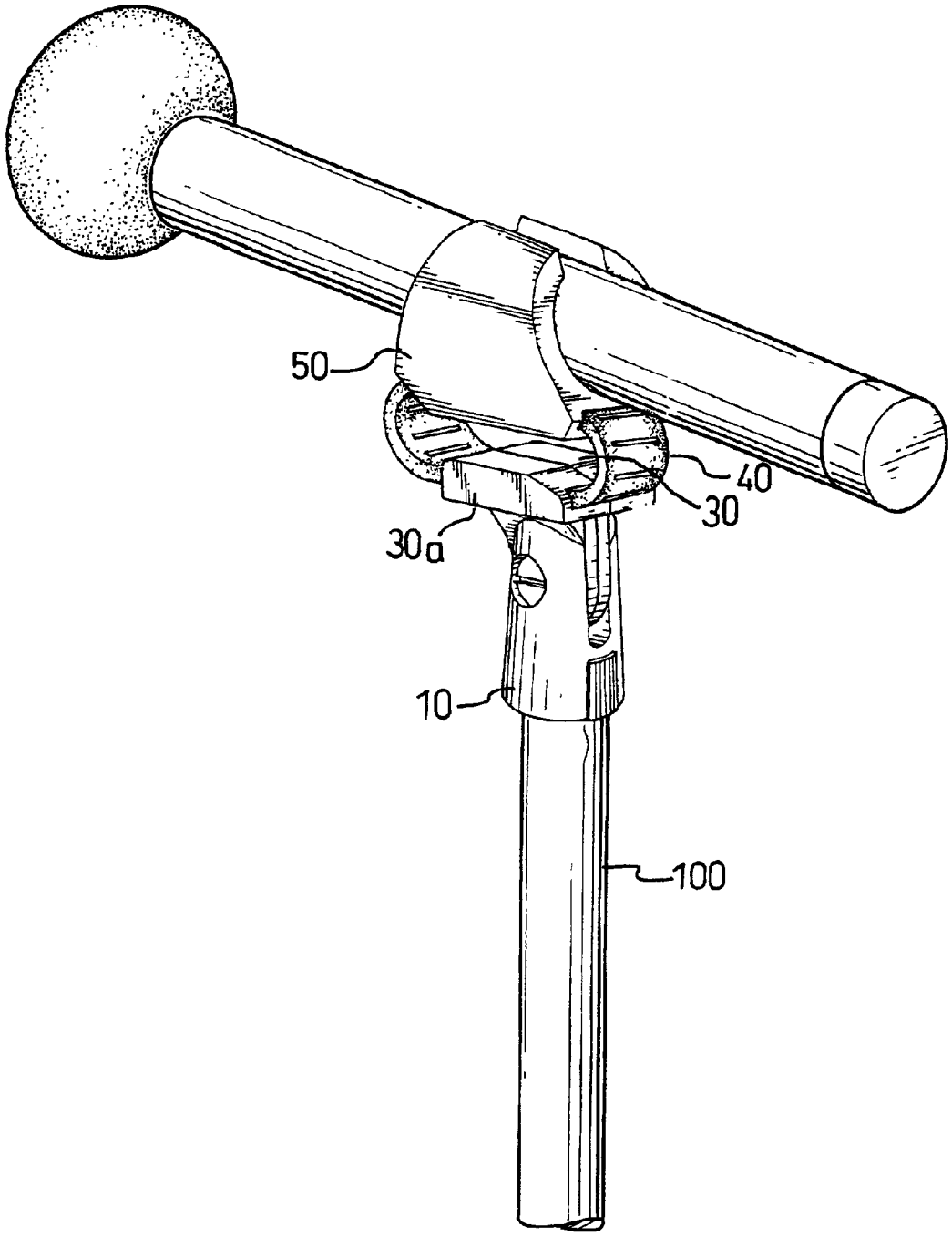
FIG. 4 is a perspective view showing the microphone support device is assembled with a microphone.
Figure 5:
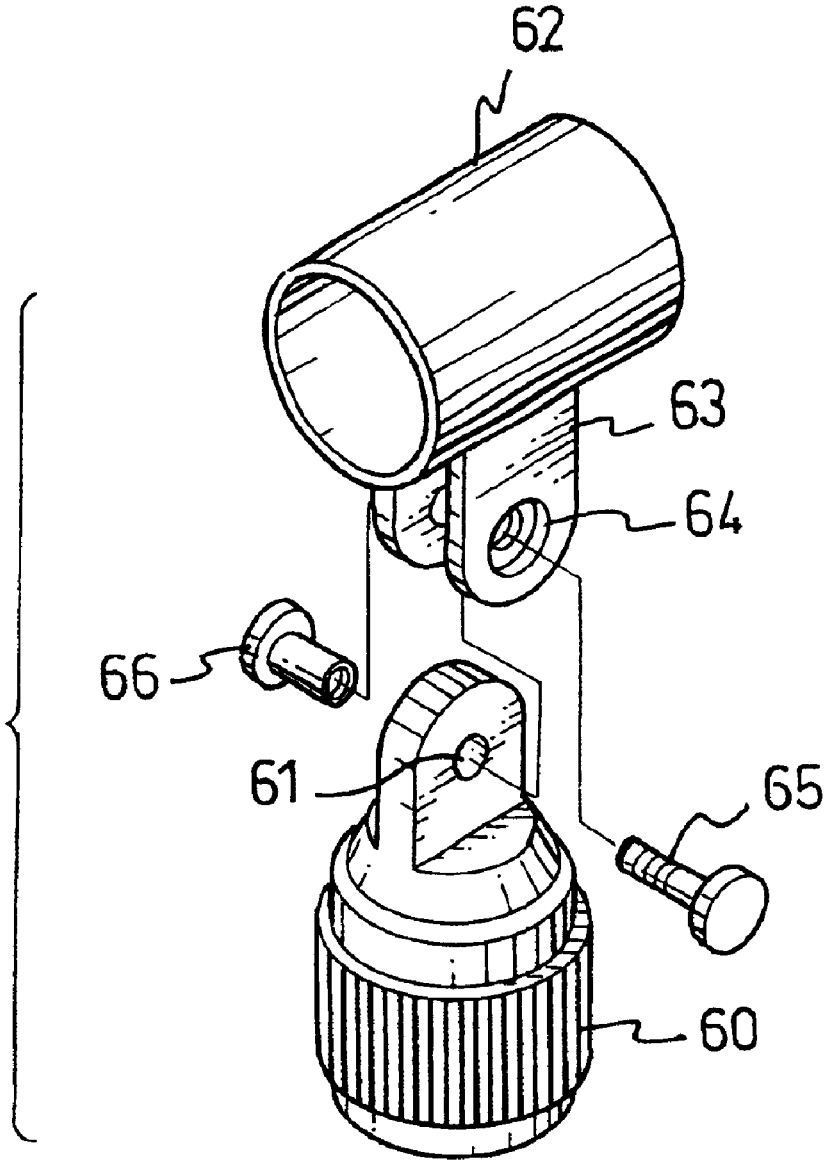
FIG. 5 PRIOR ART
FIG. 5 is an exploded perspective view of a conventional microphone support device.

With regard to FIG. 4, the retaining base (10) is screwed on one end of a support rod (100), and a microphone is received in the hollow (51) of the holder (50). If the support rod receives vibration or shock, the vibration is passed through the retaining base (10), the first and second grip plate (30,30*a*) to the shockproof strip (40). Since the material of the shockproof strip (40) is elastic material, the vibration is absorbed by the shockproof strip (40), thus the potential undesirable noises via the microphone are avoided.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A shockproof microphone support device comprising:

a supporting base, composed of a first grip plate and a second grip plate each adapted to be securely connected to a retaining base, wherein each grip plate has:

a top portion, a bottom portion, an upright portion extending between the top and the bottom portion, wherein a plurality of blocks is respectively formed on a side wall of the upright portion of the first grip plate and the second grip plate, a plurality of in holes is defined at a side wall of the top and bottom portions of the first grip plate, and a plurality of pins is defined at a side wall of the top and bottom portions of the second grip plate to correspond to the plurality of pin holes;

an ear plate downwardly extending from a flange of the bottom portion; and a U-like cross-section channel defined by the top portion, the bottom portion and the upright portion, so that when the first grip plate and the second grip plate are securely connected to the retaining base, the two U-like cross section channels of the first and second grip plates fine a passage;

a shockproof strip received in the passage and adapted to support a microphone thereon, wherein the shockproof strip is made of a flexible material and further has:

a plurality of dents formed thereon to absorb vibration; and a plurality of notches is defined in opposed edges of the shockproof strip, whereby after the shockproof strip is received in the passage, the plurality of blocks of the first grip plate and the second grip plate is respectively received in the plurality of notches of the shockproof strip so as to secure the shockproof strip relative to the first grip plate and the second grip plate.

* * * * *